US011386834B2

(12) United States Patent
Wang et al.

(10) Patent No.: US 11,386,834 B2
(45) Date of Patent: Jul. 12, 2022

(54) LIGHT-EMITTING DIODE (LED) DISPLAY DRIVER WITH PROGRAMMABLE SCAN LINE SEQUENCE

(71) Applicant: TEXAS INSTRUMENTS INCORPORATED, Dallas, TX (US)

(72) Inventors: Yang Wang, Shanghai (CN); Huibo Zhong, Shanghai (CN); Haibin Shao, Shanghai (CN); Yan He, Shanghai (CN); Shang Ding, Shanghai (CN); Yongxiang Zhang, Shanghai (CN)

(73) Assignee: Texas Instruments Incorporated, Dallas, TX (US)

( * ) Notice: Subject to any disclaimer, the term of this patent is extended or adjusted under 35 U.S.C. 154(b) by 43 days.

(21) Appl. No.: 17/122,792

(22) Filed: Dec. 15, 2020

(65) Prior Publication Data

US 2022/0189380 A1 Jun. 16, 2022

(51) Int. Cl.
*G09G 3/32* (2016.01)

(52) U.S. Cl.
CPC ..... *G09G 3/32* (2013.01); *G09G 2310/0213* (2013.01); *G09G 2310/0267* (2013.01); *G09G 2310/08* (2013.01)

(58) Field of Classification Search
CPC ..... G09G 3/32; G09G 2310/0213; G09G 2310/0267; G09G 2310/08; G09G 2320/02; G09G 2320/0247; G09G 2310/04; G09G 2310/0224; G09G 2310/0227
See application file for complete search history.

(56) References Cited

U.S. PATENT DOCUMENTS

| | | | | |
|---|---|---|---|---|
| 2004/0239597 | A1* | 12/2004 | Tanabe | G09G 3/3258 345/212 |
| 2006/0044251 | A1* | 3/2006 | Kato | G09G 3/3648 345/98 |
| 2010/0134474 | A1* | 6/2010 | Watanabe | G09G 3/3677 345/213 |
| 2015/0187308 | A1* | 7/2015 | Shin | G09G 3/3614 345/99 |
| 2018/0268770 | A1* | 9/2018 | Nakanishi | G09G 3/3677 |
| 2019/0066560 | A1* | 2/2019 | Mi | G11C 19/28 |
| 2021/0028265 | A1* | 1/2021 | Kim | G09G 3/3283 |
| 2021/0304661 | A1* | 9/2021 | Kang | G09G 3/32 |

* cited by examiner

*Primary Examiner* — Laurence J Lee
(74) *Attorney, Agent, or Firm* — Mark A. Valetti; Charles A. Brill; Frank D. Cimino

(57) ABSTRACT

A light-emitting diode (LED) display driver circuit includes: a set of scan lines, each scan line having a respective switch; a set of channels coupled to each scan line of the set of scan lines; and a scan line controller coupled to each respective switch of the set of scan lines, the scan line controller configured to provide a programmable sequence of control signals to respective switches of the set of scan lines.

22 Claims, 13 Drawing Sheets

500

| REGISTER | REGISTER LENGTH | DEFAULT SEQUENCE | PROGRAMMED SEQUENCE |
|---|---|---|---|
| Program_order_0 | 5 BITS | LINE0 | |
| Program_order_1 | 5 BITS | LINE1 | |
| Program_order_2 | 5 BITS | LINE2 | |
| ○<br>○<br>○ | ○<br>○<br>○ | ○<br>○<br>○ | ○<br>○<br>○ |
| Program_order_29 | 5 BITS | LINE29 | |
| Program_order_30 | 5 BITS | LINE30 | |
| Program_order_31 | 5 BITS | LINE31 | |

FIG. 5A

510

| REGISTER NAME | Max_scan_line # | DEFAULT SEQUENCE | STATUS |
|---|---|---|---|
| Program_order_0 | 20 | LINE0 | ACTIVE |
| ○<br>○<br>○ | | ○<br>○<br>○ | |
| Program_order_19 | | LINE19 | |
| Program_order_20 | | N/A | INACTIVE |
| ○<br>○<br>○ | | | |
| Program_order_31 | | | |

FIG. 5B

600

| PHYSICAL LINE # | SCAN SEQUENCE | SRAM READ SEQUENCE |
|---|---|---|
| LINE0 | LINE0 | Data_0 |
| LINE1 | LINE1 | Data_1 |
| LINE2 | LINE2 | Data_2 |
| ⋮ | ⋮ | ⋮ |
| LINE29 | LINE29 | Data_29 |
| LINE30 | LINE30 | Data_30 |
| LINE31 | LINE31 | Data_31 |

FIG. 6A
(PRIOR ART)

610

| PHYSICAL LINE # | PROGRAMMED SCAN SEQUENCE | SRAM READ SEQUENCE |
|---|---|---|
| LINE0 | LINE31 | Data_31 |
| LINE1 | LINE30 | Data_30 |
| LINE2 | LINE29 | Data_29 |
| ⋮ | ⋮ | ⋮ |
| LINE29 | LINE2 | Data_2 |
| LINE30 | LINE1 | Data_1 |
| LINE31 | LINE0 | Data_0 |

FIG. 6B

LIGHT-EMITTING DIODE (LED) DISPLAY DRIVER WITH PROGRAMMABLE SCAN LINE SEQUENCE

BACKGROUND

The proliferation of electronic devices and integrated circuit (IC) technology has resulted in the commercialization of IC products. As new electronic devices are developed and IC technology advances, new IC products are commercialized. One example IC product for electronic devices is a light-emitting diode (LED) driver. In LED devices, there are some trends: the number of red-green-blue (RGB) LED pixels are increasing (e.g., up to 4K pixels and more than 15K LED drivers); the pitch between pixels is decreasing; and the refresh rate (e.g., up to 4 KHz) is increasing to account for increases in camera shutter speed (to avoid visibility of dimming lines in photography of LED signage). As an example, to achieve a 16-bit pulse-width modulation (PWM) with a 4 KHz refresh rate, a dock signal rate higher than 200 MHz is needed. Trends that increase the concentration of ICs, pins, and traces on a printed circuit board (PCB) for LED displays undesirably increase cost and complexity of LED display circuitry.

SUMMARY

In an example embodiment of the description, a light-emitting diode (LED) display driver circuit comprises: a set of scan lines, each scan line having a respective switch; a set of channels coupled to each scan line of the set of scan lines; and a scan line controller coupled to each respective switch of the set of scan lines, the scan line controller configured to provide a programmable sequence of control signals to respective switches of the set of scan lines.

In another example embodiment of the description, a system comprises: a LED display controller; and an LED display driver circuit coupled to the LED display controller and configured to receive LED data from the LED display controller. The LED display driver circuit including: a set of scan lines, each scan line having a respective switch; a set of channels coupled to each scan line of the set of scan lines; and a scan line controller coupled to each respective switch of the set of scan lines, the scan line controller configured to provide a programmable sequence of control signals to respective switches of the set of scan lines.

In another example embodiment of the description, a method comprising: receiving, by a LED display driver circuit, a scan line sequence code; generating, by the LED display driver circuit, a sequence of control signals based on the scan line sequence code; and using, by the LED display driver circuit, the sequence of control signals to control switches of a set of scan lines of the LED display driver circuit.

BRIEF DESCRIPTION OF THE DRAWINGS

FIG. 5A is a table showing programmable scan line sequence information in accordance with an example embodiment.

FIG. 5B is a table showing additional programmable scan line sequence information in accordance with an example embodiment.

FIG. 6A is a table showing scan line sequence and memory information in accordance with a conventional technique.

FIG. 6B is a table showing programmable scan line sequence memory and information in accordance with a conventional technique.

DETAILED DESCRIPTION

Figure 1:
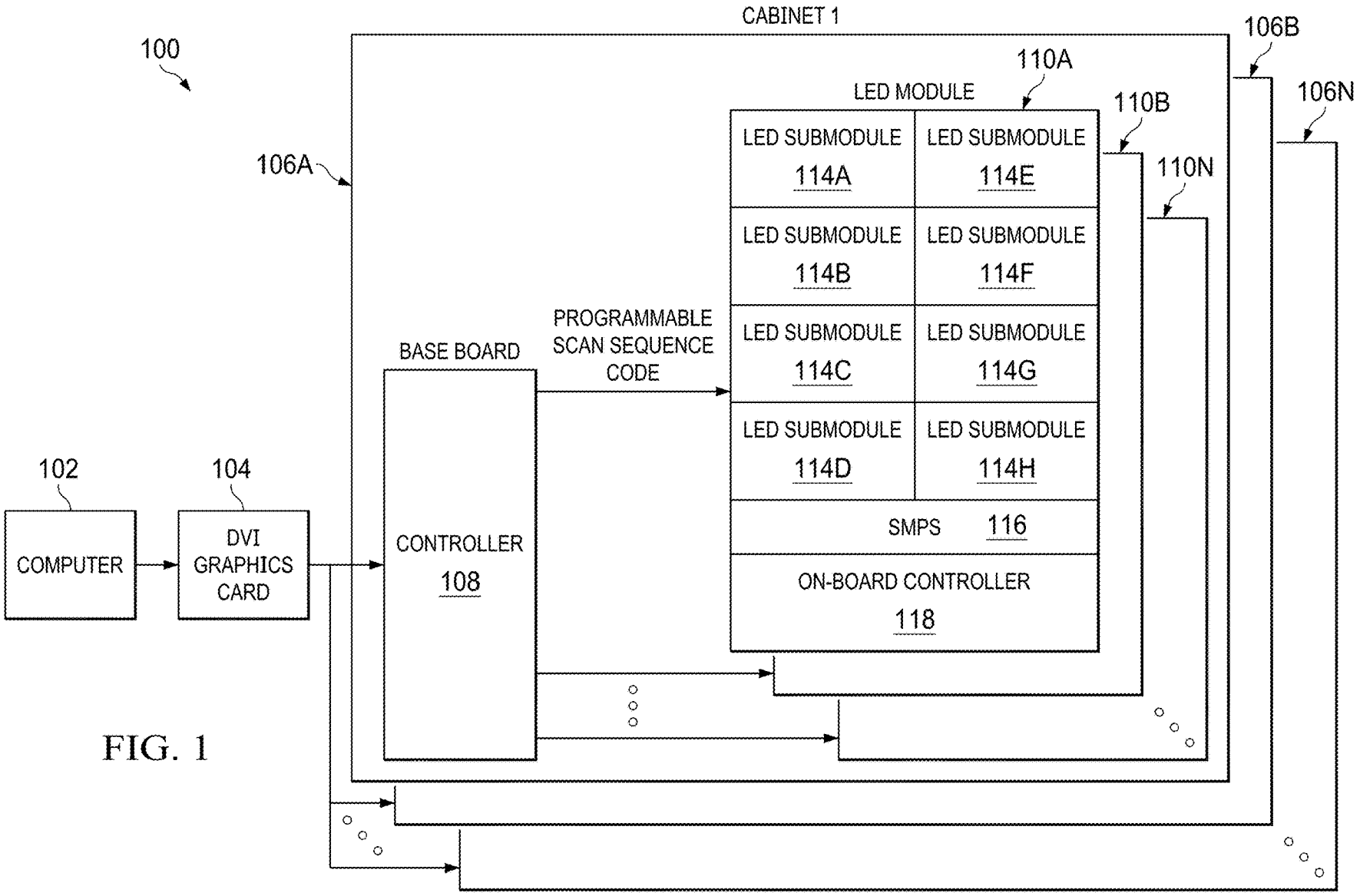
FIG. 1 is a block diagram of a system in accordance with an example embodiment.

Described herein is a light-emitting diode (LED) display driver circuit with programmable scan lines and related circuitry. In some example embodiments, an LED display driver circuit includes: a set of scan lines, each scan line having a switch; and a scan line controller configured to provide a programmable sequence of control signals to respective switches of the set of scan lines. In some example embodiments, the LED display driver circuit is an integrated circuit (IC). Also described herein are related systems or devices (e.g., LED signage) that use an LED display driver circuit. In an example system, a plurality of LED display driver circuits are coupled to an LED display controller, which provides LED data to each LED display driver circuit. In one example embodiment, the LED display controller is configured to provide a scan line sequence code to each LED display driver circuit, where each LED display driver circuit is configured to provide a sequence of control signals to respective switches of the set of scan lines based on the scan line sequence code.

As an example, the LED display controller may provide the scan line sequence code to each LED display driver circuit with the LED data. In such case, each LED display driver circuit is configured to decode or parse the scan line sequence code from the LED data for later use (e.g., to generate the sequence of control signals to respective switches of the set of scan lines). In other example embodiments, each LED display driver circuit is able to provide a programmable sequence of control signals to respective switches of the set of scan lines in another way (e.g., using a separate communication pin or time multiplexed communications to receive a scan line sequence code).

One use of the programmable sequence of control signals is to increase (e.g., double or triple) the apparent refresh rate of an LED display driver circuit. In such case, the programmable sequence of control signals includes multiple partial sequences of control signals performed in order, each of the multiple partial sequences of control signals configured to skip over some of the switches of the set of scan lines. To double the apparent refresh rate, the multiple partial sequences includes a first partial sequence of control signals and a second partial sequence of control signals, the first partial sequence of control signals configured to skip over every other switch of the set of scan lines in order, and the second partial sequence of control signals configured to skip over switches related to the first partial sequence of control signals. Without limitation, if there are 20 scan lines, a first partial sequence of control signals is used to control scan lines 1, 3, 5, 7, 9, 11, 13, 15, 17, 19 in order. After the first partial sequence is complete, a second partial sequence is used to control scan lines 2, 4, 6, 8, 10, 12, 14, 16, 18, and 20 in order. Other partial sequences are possible.

The result of using these or other sets of partial sequences for control of scan lines of LED display driver circuits is that an LED display will have a faster apparent refresh rate. In reality, some of the scan lines are skipped for each partial sequence of each LED display driver circuit, but the skipped scan lines do not significantly affect the displayed image visible to the camera. When the refresh rate of an LED display is below a target shutter speed, photography of the LED display by a camera may include undesirable dimming lines.

By increasing the apparent refresh rate as described herein, the visible refresh rate is higher than a target camera shutter speed and photography of LED signage avoids dimming lines without increasing a system clock rate. Use of a programmable sequence of control signals for switches of a set of scan lines and use of a lower system clock rate facilitates the design of LED signage circuitry layout, which may use thousands of LED display driver circuits and related printed circuit boards (PCBs) and LED display controllers. To provide a better understanding, LED display driver circuits with a programmable sequence of control signals for scan line switches as well as related options and systems are described using the figures as follows.

FIG. 1 is a block diagram of a system 100 in accordance with an example embodiment. In some example embodiments, the system 100 is an LED display device (sometimes referred to as LED signage). As shown, the system 100 includes a computer 102 that provides the source of the graphics and communicates with a digital visual interface (DVI) graphics card 104. In operation, the DVI graphics card 104 converts graphics source data and provides the data to a plurality of cabinets 106A-106N, where each of the cabinets 106A-106N includes a base board controller 108 and a plurality of LED modules 110A-110N. In different examples, the DVI graphics card 104 provides the same graphics data or different graphics data to each of the cabinets 106A-106N, where each of the cabinets 106A-106N is associated with a different LED display.

In the example of FIG. 1, each of the plurality of LED modules 110A-110N includes a plurality of LED submodules 114A-114H, a switched-mode power supply (SMPS) 116, and an on-board controller 118 (sometimes referred to herein as an LED display controller). In operation, each base board controller 108 is configured to receive graphics data from the DVI graphics card 104 and to provide LED data or related data to each LED module 110A-110N. For example, each on-board controller 118 of each respective LED module 110A-110N is configured to receive LED data or related data from a respective base board controller 108 and to provide a sub-set of the LED data or related data to each of the LED submodules 114A-114H.

In operation, each of the LED submodules 114A-114H is configured to manage the amount of current provided to respective pixels (e.g., red, green, blue pixels), where current flow to each pixel is a function of scan line operations as well as current source or current sink operations. As described herein, LED display driver circuits (e.g., the LED submodules 114A-114H) use a programmable sequence of control signals to control switches of a set of scan lines. In some example embodiments, the same sequence of control signals is used for each of the LED submodules 114A-114H of a respective cabinet. Also, each of the cabinets 106A-106N may use the same sequence of control signals or a different sequence of control signals to control switches of a set of scan lines for respective LED submodules 114A-114H. Regardless of the particular sequence of control signals in use for a particular cabinet, the sequence of control signals is programmable or adjustable.

One use of a programmable sequence of control signals for scan line switches is to increase (e.g., double or triple) the apparent refresh rate of each LED submodule 114A-114H. In such case, the programmable sequence of control signals includes multiple partial sequences of control signals performed in order, each of the multiple partial sequences of control signals configured to skip over some of the switches of the set of scan lines. By increasing the apparent refresh rate, the visible refresh rate is higher than a target camera shutter speed and photography of LED signage avoids dimming lines without increasing a system clock rate. Use of a programmable sequence of control signals for switches of a set of scan lines and use of a lower system clock rate facilitates the design of LED signage circuitry layout, which may use thousands of LED display driver circuits along with related PCBs and LED display controllers.

Figure 2:
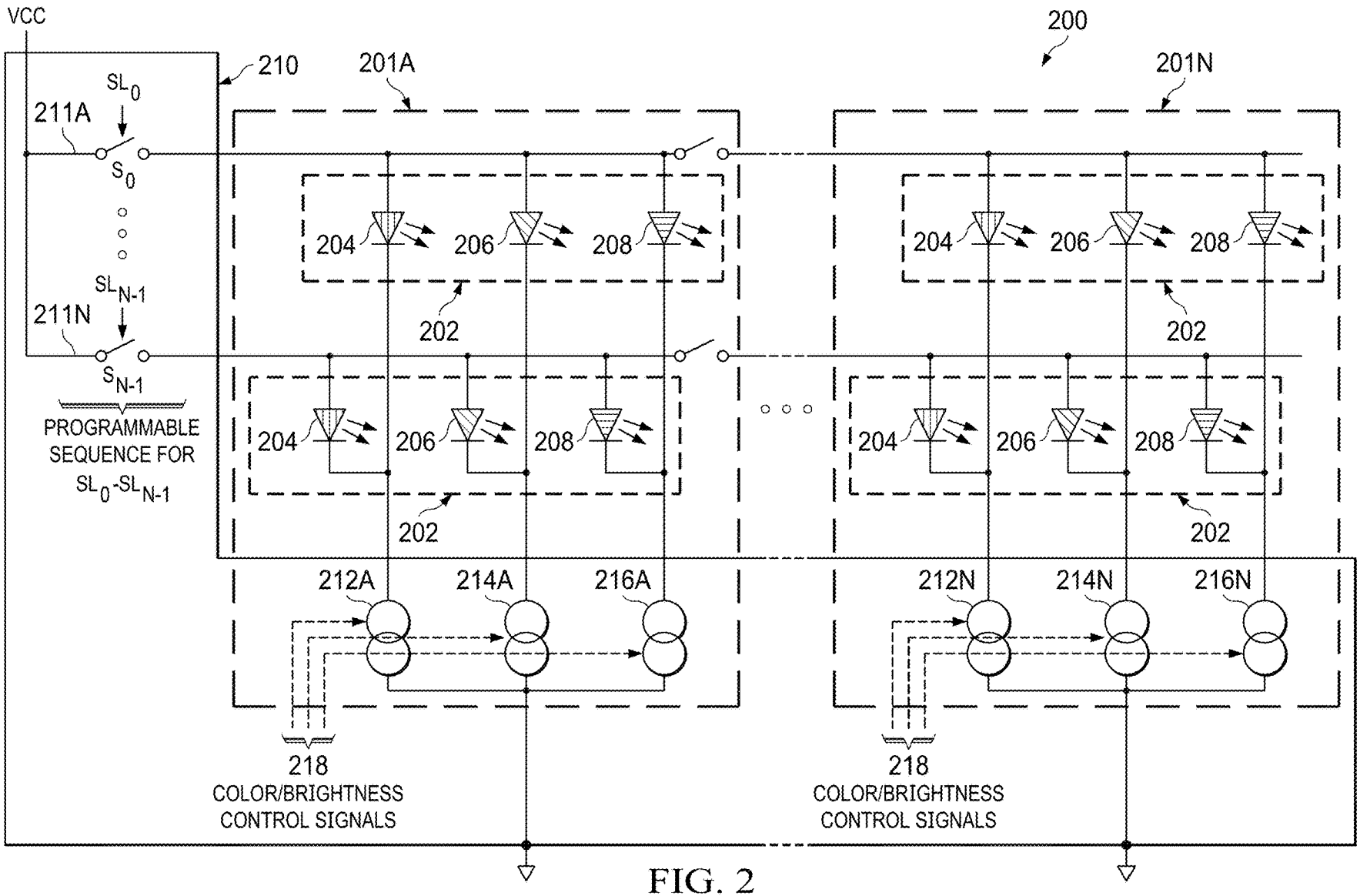
FIG. 2 is a diagram of part of a light-emitting diode (LED) display driver circuit in accordance with an example embodiment.

FIG. 2 is a diagram of part of an LED display driver circuit 200 (part of each LED submodule 114A-114H in FIG. 1) in accordance with an example embodiment. As shown, the LED display driver circuit 200 includes a circuit 210 (e.g., part of an IC) with a plurality of scan lines 211A-211N with respective scan lines switches $S_0$-$S_{N-1}$. For each of the scan lines 211A-211N, there is a set of channels 201A-201N that are active when switches $S_0$-$S_{N-1}$ are closed and that are inactive when $S_0$-$S_{N-1}$ are open. In the example of FIG. 2, there is a separate set of pixels 202 for each of the scan lines 211A-211N and each of the channels 201A-201N, where each set of pixels 202 includes a red pixel 204, a green pixel 206, and a blue pixel 208. By controlling the scan lines switches $S_0$-$S_{N-1}$ and respective current sinks 212A-212N, 214A-214N, and 216A-216N, pixel color and brightness levels are controlled for each pixel. More specifically, the scan lines switches $S_0$-$S_{N-1}$ are controlled by a programmable sequence of control signals $SL_0$-$SL_N$, and the current sinks 212A-212N, 214A-214N, and 216A-216N are controlled by color/brightness control signals 218.

One option for the programmable sequence of control signals $SL_0$-$SL_{N-1}$ is to increase (e.g., double or triple) the apparent refresh rate of the LED display driver circuit 200 as described herein. In one example, the programmable sequence of control signals $SL_0$-$SL_{N-1}$ includes multiple partial sequences of control signals performed in order, each of the multiple partial sequences of control signals configured to skip over some of the switches $S_0$-$S_{N-1}$. Without limitation, a first partial sequence of control signals is used to operate even numbered scan line switches (e.g., $S_0$, $S_2$, etc.) in order. After the first partial sequence of control signals is complete, a second partial sequence of control signals is used to control odd numbered scan line switches (e.g., $S_1$, $S_3$, etc.) in order. In this manner, the apparent refresh rate of the LED display driver circuit 200 is doubled without increasing a system clock rate. One example strategy is to increase the apparent refresh rate so that the visible refresh rate is higher than a target camera shutter speed and thus avoid dimming lines in LED signage photography without increasing a system clock rate. Also, use of a programmable sequence of control signals $SL_0$-$SL_{N-1}$ for scan line switches $S_0$-$S_{N-1}$ can facilitate the layout of LED signage circuitry, which may use thousands of LED display driver circuits along with related PCBs and LED display controllers.

Figure 3A:
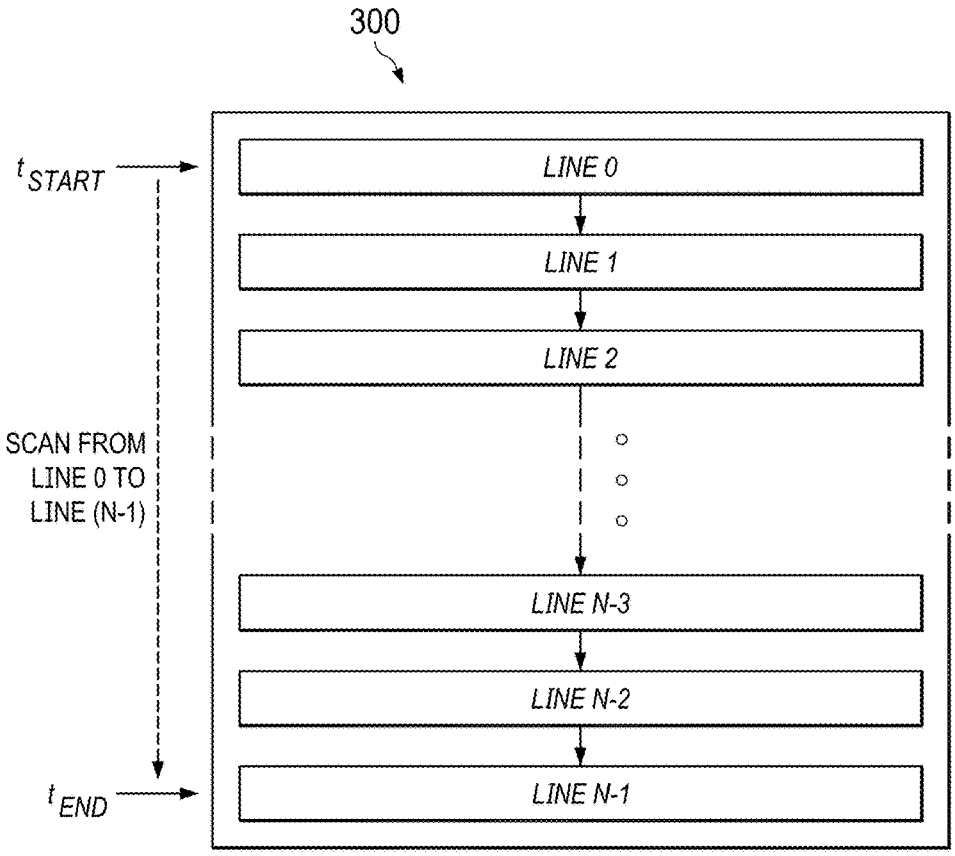
FIG. 3A (PRIOR ART)
FIG. 3A is a block diagram of a scan line sequence in accordance with a conventional technique.
Figure 3B:
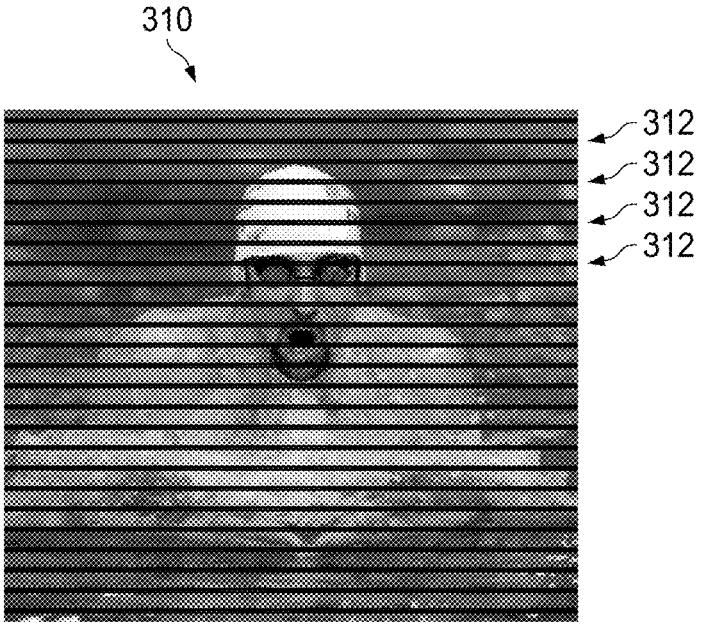
FIG. 3B (PRIOR ART)
FIG. 3B is an image of photography with dimming lines due to the conventional scan line sequence of FIG. 3A.

FIG. 3A is a block diagram of a scan line sequence 300 in accordance with a conventional technique. In the scan line sequence 300, the scan lines are scanned in order from scan line 0 (e.g., scan line 211A in FIG. 2) to scan line N−1 (e.g., scan line 211N in FIG. 2) starting at time $t_{START}$ and ending at time $t_{END}$. The result of the scan line sequence 300 is represented in FIG. 3B, which shows an image 310 of photography with dimming lines 312 due to the refresh rate of LED display driver circuits being less than a target camera shutter speed.

Figure 4A:
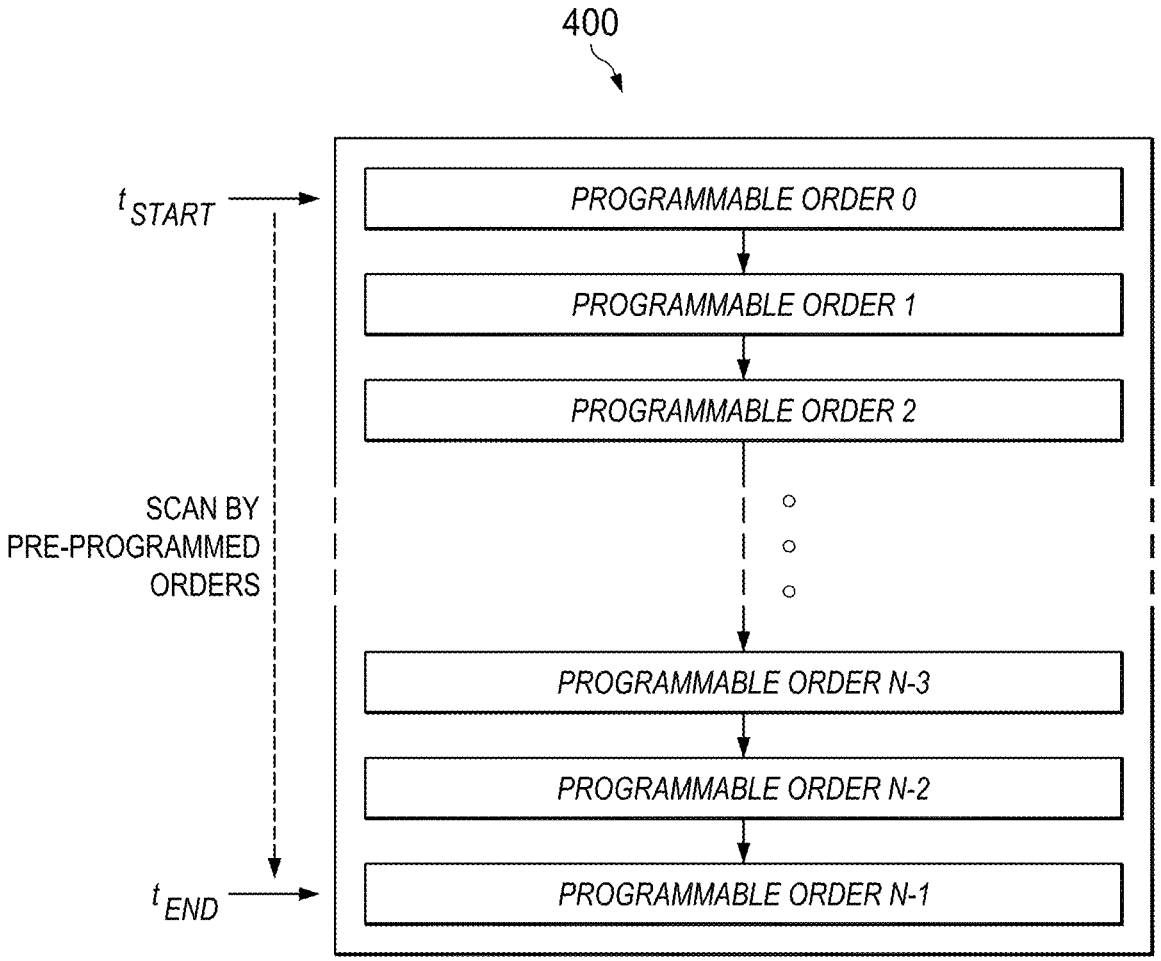
FIG. 4A is a block diagram of a programmable scan line sequence in accordance with an example embodiment.
Figure 4B:
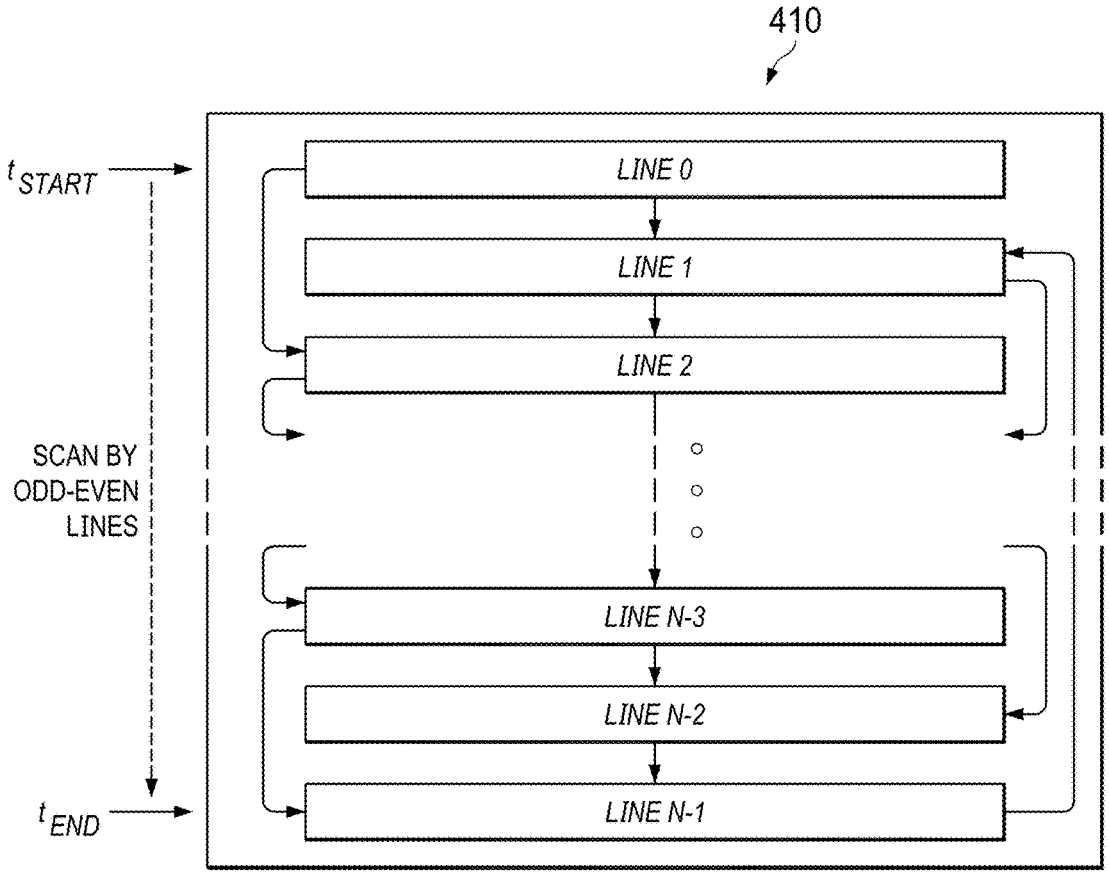
FIG. 4B is a block diagram of a programmable scan line sequence in accordance with an example embodiment.

FIG. 4A is a block diagram of a programmable scan line sequence 400 in accordance with an example embodiment. In the scan line sequence 400, the scan lines are scanned in a programmable order (e.g., using $SL_0$-$SL_{N-1}$ of FIG. 2 in a programmable order) starting at time $t_{START}$ and ending at time $t_{END}$. One option for the programmable scan line sequence 400 doubles the apparent refresh rate of an LED display driver circuit (e.g., each of the LED submodules 114A-114F in FIG. 1, or the LED display driver circuit 200 in FIG. 2) as described herein. To double the apparent refresh rate of an LED display driver circuit, the programmable scan line sequence 400 includes multiple partial sequences of control signals performed in order, where each of the multiple partial sequences of control signals is configured to skip over some of the scan line switches. Without limitation, a first partial sequence of control signals of the programmable scan line sequence 400 controls even numbered scan line switches (e.g., $S_0$, $S_2$, etc., in FIG. 2) in order. After the first partial sequence of control signals is complete, a second partial sequence of control signals of the programmable scan line sequence 400 controls odd numbered scan line switches (e.g., $S_1$, $S_3$, etc., in FIG. 2) in order. This programmable scan line sequence with even and odd partial sequences is represented by the programmable scan line sequence 410 in FIG. 4B. In this manner, the apparent refresh rate of an LED display driver circuit is doubled without increasing a system clock rate.

In other example embodiments, the programmable scan line sequence 400 is used to triple the apparent refresh rate of an LED display driver circuit (e.g., using three partial sequences of control signals). In other example embodiments, the programmable scan line sequence 400 is customized to facilitate outputting scan line signals of an LED display driver circuit to a PCB or otherwise facilitate layout of LED display driver circuits and/or other LED display circuitry on a PCB.

Figure 4C:
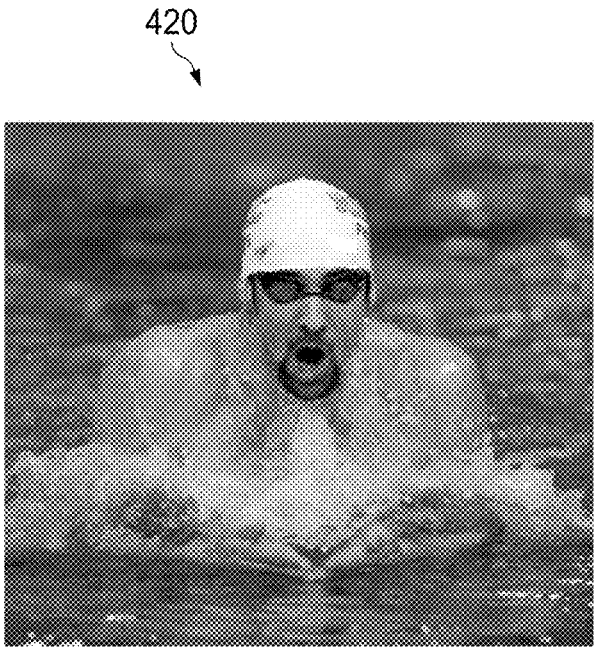
FIG. 4C is an image of photography without dimming lines due to the programmable scan line sequence of FIG. 4A or FIG. 4B.

FIG. 4C is an image 420 of photography without dimming lines due to the programmable scan line sequence 400 of FIG. 4A (e.g., the programmable scan line sequence 410 of FIG. 4B) doubling or tripling the apparent refresh rate of LED display driver circuits of an LED display. Use of the programmable scan line sequence 400 for switches of a set of scan lines and use of a lower system clock rate facilitates the design of LED signage circuitry layout, which may use thousands of LED display driver circuits along with related PCBs and LED display controllers.

FIG. 5A is a table 500 showing programmable scan line sequence information in accordance with an example embodiment. In table 500, 32 scan lines are assumed and the columns of table 500 include a register column, a register length column, a default sequence column, and a programmed sequence column. The register column of table 500 identifies the registers program_order_0 to program_order_31 used to store programmable sequence information. The register length column of table 500 identifies the length of each register identified in the register column. Since there are 32 scan lines in this example, the register length for each register is 5 bits, which enables the numbers 0 (00000) to 31 (11111) to be stored or updated to identify a programmed sequence. The default sequence column for table 500 identifies a default scan line sequence (e.g., Line_0 to Line_31, or 00000 to 11111 in sequential order). The programmed sequence column for table 500 Identifies a programmed sequence of scan lines. To double the apparent refresh rate of an LED display driver circuit as described herein, the programmed sequence may include a first partial sequence of even scan lines in order (e.g., Line_0, Line_2, Line_4, etc.) followed by a second partial sequence of odd scan lines in order (e.g., Line_1, Line_3, Line_5, etc.). In some example embodiments, an LED display driver circuit includes a set of registers and/or other storage elements to store information such as the information in table 500, which is used to generate a default sequence or programmable sequence of control signals for scan line switches of the LED display driver circuit.

FIG. 5B is a table 510 showing additional programmable scan line sequence information in accordance with an example embodiment. In table 510, 32 scan lines are assumed and the columns of table 510 include a register column, a max_scan_line #column, a default sequence column, and a status column. The register column of table 510 identifies the registers program_order_0 to program_order_31 used to store programmable sequence information. The max_scan_line #column of table 510 identifies the maximum number of active scan lines, which is 20 in this example. The default sequence column for table 510 identifies a default scan line sequence (e.g., Line_0 to Line_19, or 00000 to 10011 in sequential order) up to the maximum number of active scan lines. In table 510, the registers program_order_20 to program_order_31 are inactive and are thus not applicable (N/A) to the default sequence. The status column of table 510 identifies which scan lines are active versus inactive. In table 510, Line_0 to Line_19 are active, while Line_20 to Line_31 are inactive. In some example embodiments, an LED display driver circuit includes a set of registers and/or other storage elements to store information such as the information in table 510, which is used to generate a default sequence or programmable sequence of control signals for scan line switches of the LED display driver circuit that accounts for a maximum scan line limitation and/or active versus inactive scan line options.

FIG. 6A is a table 600 showing scan line sequence and memory information in accordance with a conventional technique. In table 600, 32 scan lines are assumed and the columns of table 600 include a physical line #column, a scan sequence column, and a static random-access memory (SRAM) read sequence column. The physical line #column of table 600 identifies the physical scan line Line_0 to Line_31, the scan line sequence column of table 600 identifies a conventional scan sequence for the scan lines (e.g., sequential from Line_0 to Line_31), and the SRAM read sequence of table 600 identifies an SRAM read sequence related to providing a sequence of control signals for scan line switches related to Line_0 to Line_31 in order. If an LED display driver circuit includes a set of registers and/or other storage elements to store information such as the information in table 600, the resulting scan sequence will be sequential, which results in dimming lines in photography if the refresh rate of an LED display driver circuit is less than a target shutter speed. This is because the vertical distribution of LED rows that are lit up by a sequential sequence of scan line control signals within a target time interval (faster than new camera shutter rates) does not cover the entire distribution of LED rows (leaving a block of sequential LED rows unlit for LED display photography). In should be noted that visibility of LED displays by the human eye is not the issue. Rather, the described solutions are to ensure that camera photography captured by cameras with reduced shutter speeds show LED display images without dimming lines (due to the refresh rate relative to the camera shutter speed). Also, with a sequential scan line sequence, the layout complexity of LED display driver circuits and/or other circuitry on an LED display PCB may increase. In particular, a fixed pin layout and a fixed sequential scan line sequence results in more overlapping traces with stacked LED display driver circuits as described for FIG. 9A. Using programmable scan line sequencing to avoid overlapped PCB traces simplifies PCB layout as described for FIG. 9B.

FIG. 6B is a table 610 showing scan line sequence and memory information in accordance with an example embodiment. In table 610, 32 scan lines are assumed and the columns of table 610 include a physical line #column, a programmed scan sequence column, and a static random-access memory (SRAM) read sequence column. The physical line #column of table 610 identifies the physical scan line Line_0 to Line_31, the programmed scan line sequence column of table 610 identifies a programmed scan sequence for the scan lines (e.g., a reverse sequence from Line_31 to Line_0), and the SRAM read sequence of table 610 identifies an SRAM read sequence related to providing a programmed sequence of control signals to scan line switches related to Line_31 to Line_0 in reverse order. If an LED display driver circuit includes a set of registers and/or other storage elements to store information such as the information in table 610, the resulting scan sequence may be used to reduce layout complexity of LED display driver circuits and/or other circuitry on an LED display PCB. The layout complexity is due to a fixed pin layout and a fixed sequencing order, which results in overlapping PCB traces when LED display driver circuits are stacked as described in FIG. 9A. In some examples, reverse sequencing may be combined with other programmed sequences to increase the apparent refresh rate of an LED display driver circuit as described herein.

In some example embodiments of an LED display driver circuit, SRAM is implemented to achieve data transmission and image display simultaneously. For a fixed line sequence as in FIG. 6A, the SRAM address is defined from Line 0 to Line N−1, and data is shifted in and out following the line's sequence. For a programmable line sequence as in FIG. 6B, users do not need to adjust the SRAM data sequence according to the programmed line sequence. Instead, the LED display driver circuit will modify the SRAM read sequence automatically.

Figure 7:
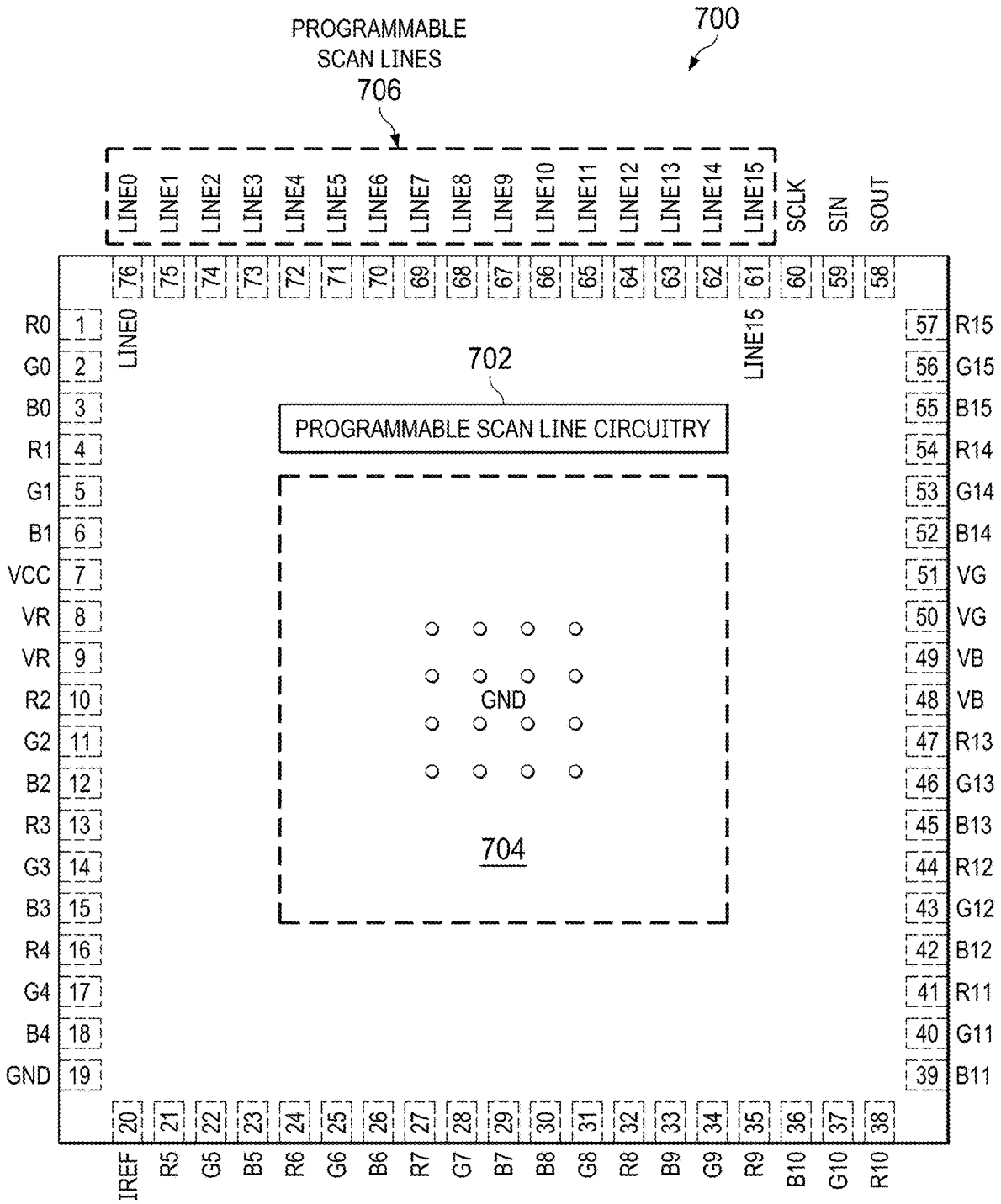
FIG. 7 is an LED display driver circuit layout in accordance with an example embodiment.
Figure 11:
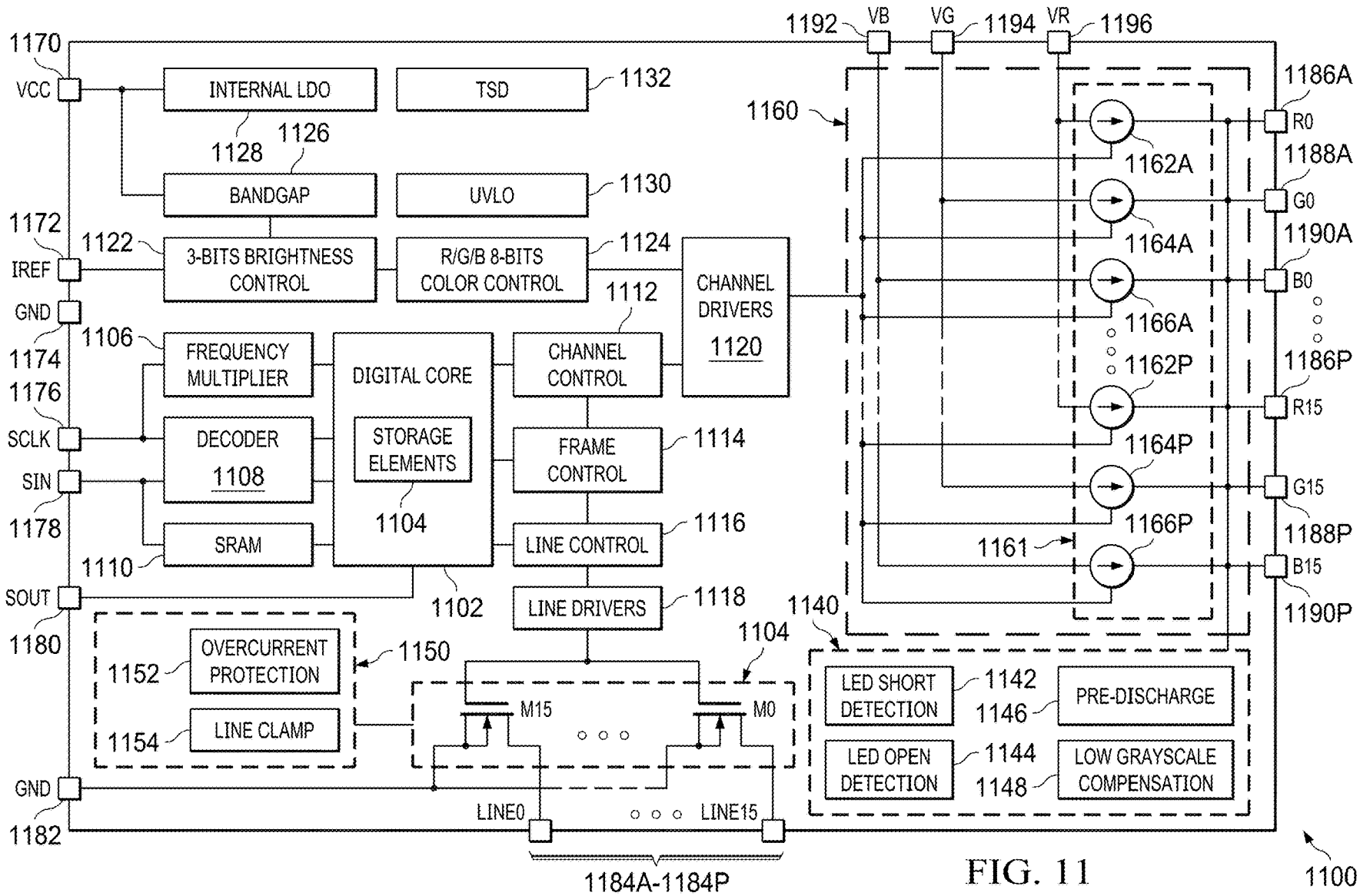
FIG. 11 is a diagram of an LED display driver circuit in accordance with an example embodiment.

FIG. 7 is an LED display driver circuit pin layout 700 (e.g., each driver circuit 700 represents an LED submodules 114A-114H in FIG. 1, the LED display driver circuit 200 of FIG. 2, or the LED display driver circuit 1100 in FIG. 11) in accordance with an example embodiment. As shown, the LED display driver circuit layout 700 includes programmable scan line circuitry 702. Example components of the programmable scan line circuitry 702 include: a decoder to decode a scan line sequence code; storage elements to store the scan line sequence code or related information (e.g., a programmable scan line sequence such as the programmable scan line sequence 400 in FIG. 4A, the information in table 500 of FIG. 5A, the information in table 610 of FIG. 6B, etc.); storage elements to store active/inactive scan line information (e.g., the information in table 510 of FIG. 5B); a scan line controller configured to generate control signals for scan line switches responsive to the scan line sequence code, related information, and/or active/inactive scan line information.

Figure 8:
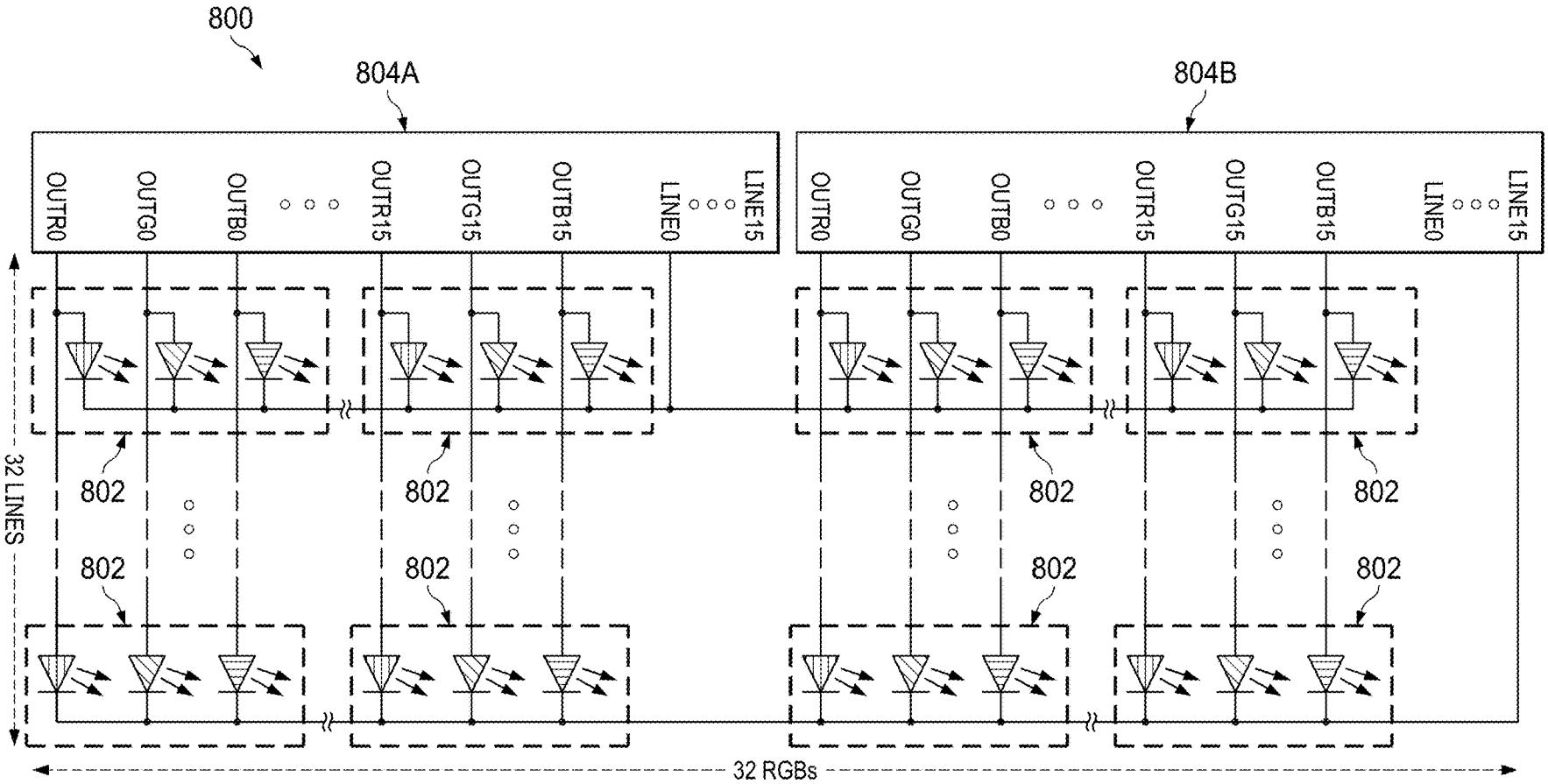
FIG. 8 is a diagram of outputs for a stackable pair of LED display driver circuits in accordance with an example embodiment.
Figure 9A:
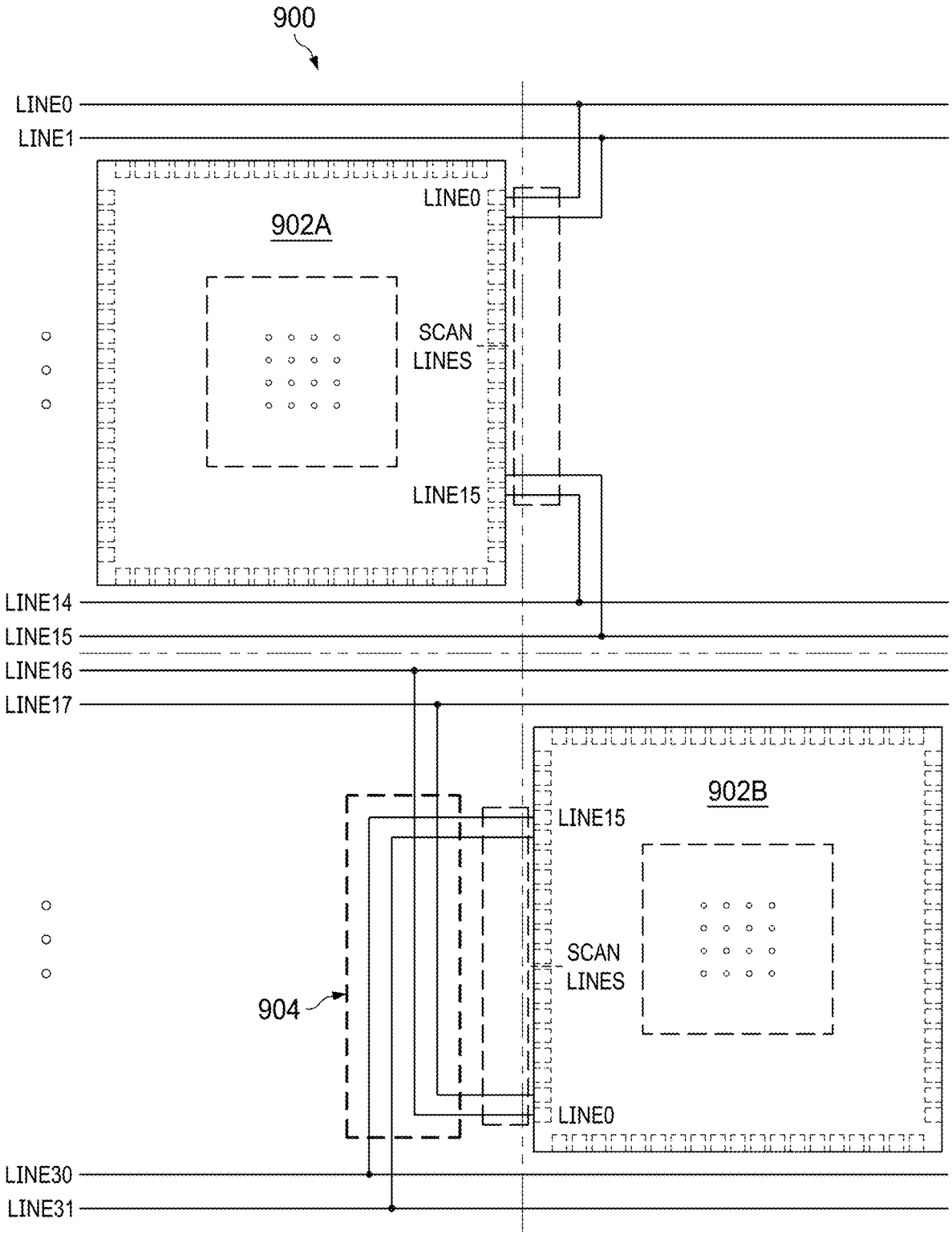
FIG. 9A (PRIOR ART)
FIG. 9A is a diagram of a stackable pair of LED display driver circuits in accordance with a convention technique.

As shown, the LED display driver circuit layout 700 also includes a ground 704 as well as plurality of pins or contacts 1-76 (as used herein, pins and contacts may mean, for example, ball bonds, pins, leads, terminals, or other form of contacts for providing an electrical, physical or thermal connection to a packaged semiconductor device). More specifically, there are respective pins (pins 1-6, 10-18, and 21-57) for red-blue-green (RGB) pixels of 16 channels (R0-R16, G0-B15, B0-B15). There are also respective pins (pins 7-9, 19-20, and 48-51) for a supply voltage (VCC), a red output supply voltage (VR), a blue output supply voltage (VB), a green output supply voltage (VG), GND, and a reference current (IREF). There are also respective pins (pins 58-60) for a data output (SOUT), a data input (SIN), and a clock signal (SCLK) for communications in accordance with a protocol such as serial peripheral interface (SPI). There are also respective pins (pins 61-76) for 16 scan line outputs (Line0-Line15). In different examples, the LED display driver circuit layout 700 is used with common cathode LEDs or common anode LEDs. In either case, programmable scan line sequencing may be used to increase the apparent refresh rate of Line0-Line15 to avoid dimming lines in LED display photography as described herein. Additionally or alternatively, the scan line sequencing of Line0-Line15 can be programmed (e.g., reversed) to avoid overlapping PCB traces as described in FIGS. 9A and 9B. In some example embodiments, the same advantages could be achieved by customizing the FIG. 8 is a diagram of outputs for a stackable pair of LED display driver circuits 804A and 804B (e.g., two of the LED submodules 114A-114H, or two of the LED display driver circuits 200, or two LED display driver circuits related to the layout 700 of FIG. 7) in accordance with an example embodiment. As shown, each of the LED display driver circuits 804A and 804B includes RGB outputs for 16 channels as well as 16 scan line outputs. In the example of FIG. 8, the stackable LED display driver circuits 804A and 804B support 32 total lines and 32 total RGB channels (twice as many pixel sets 802 are supported by the stackable pair of LED display driver circuits 804A and 804B compared to a pair of non-stackable LED display driver circuits). In some example embodiments, stackable LED display driver circuits are used with scan lines that are strictly center aligned to minimize the parasitic inductance impact. With a fixed or sequential scan line sequence, the layout of the scan lines for a pair of stackable LED display driver circuits includes some complex connections (e.g., overlapping connections) as shown in FIG. 9A. With a programmable scan line sequence, the layout of the scan lines for a pair of stackable LED display driver circuits is simpler (no overlapping connections) and the two LED display driver circuits are symmetrical.

FIG. 9A is a diagram of a stackable pair of LED display driver circuits 902A and 902B without programmable scan line circuitry in accordance with a conventional technique. In the example of FIG. 9A, some of the traces 904 extending from scan line outputs of the LED display driver circuit 902B cross over each other when using the stackable pair of LED display driver circuits 902A and 902B together resulting in a high complexity PCB payout.

Figure 9B:
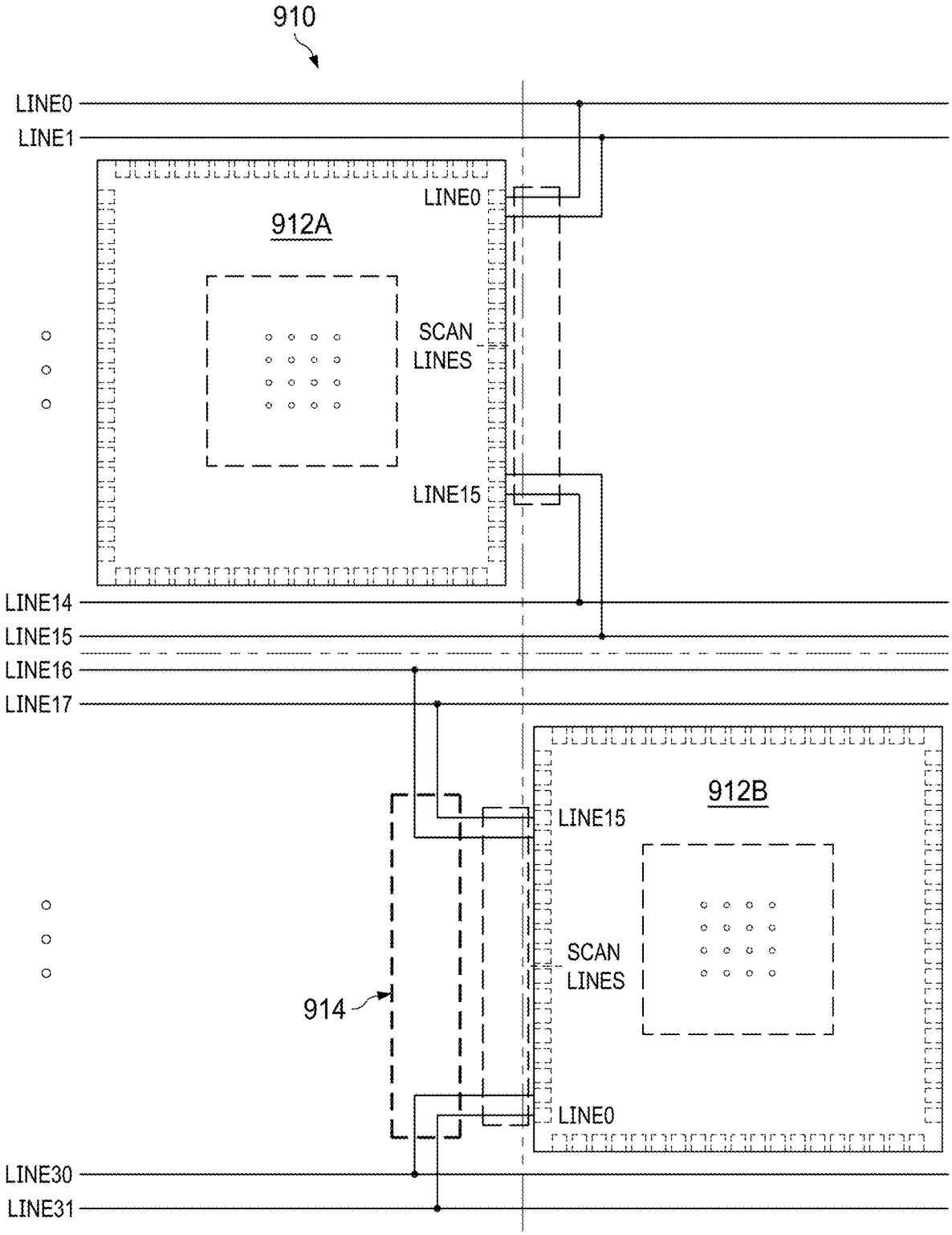
FIG. 9B is a diagram of stackable pair of LED display driver circuits in accordance with an example embodiment.

FIG. 9B is a diagram of stackable pair of LED display driver circuits 912A and 912B with programmable scan line circuitry (e.g., the programmable scan line circuitry 702 in FIG. 7) in accordance with an example embodiment. In the example of FIG. 9A, programmable scan line circuitry is used to adjust the scan line outputs so that the traces 914 extending from scan line outputs of the LED display driver circuit 902B do not cross over each other when using the stackable pair of LED display driver circuits 912A and 912B together resulting in a lower complexity PCB payout compared to the arrangement of FIG. 9A.

Figure 10:
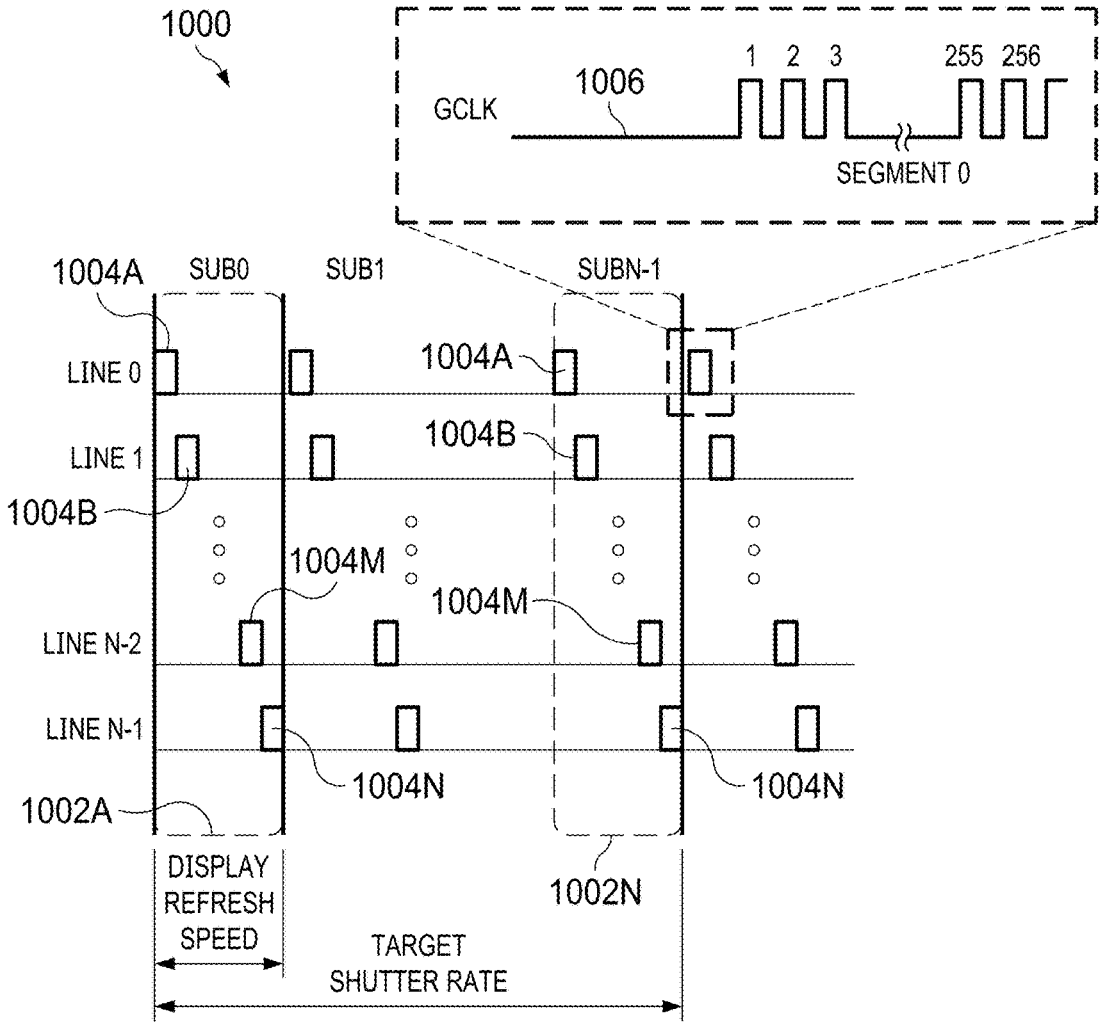
FIG. 10 is a timing diagram of scan line operations and related parameters in accordance with an example embodiment.

FIG. 10 is a timing diagram 1000 of scan line operations 1004A-1004N and related parameters in accordance with an example embodiment. In the timing diagram 1000, the scan line operations 1004A-1004N are repeated for each of intervals 1002A-1002N (labeled Sub0 to SubN−1), where the duration of each of the intervals 1002A-1002N is based on the display refresh speed. As shown, the duration of each of the intervals 1002A-1002N is less than a target shutter rate. The dimming or flickering issue is a common issue for a matrix of LED display driver circuits when taking photos with a high speed camera. To avoid this issue, the minimum refresh rate of an LED display should be at least 2 times higher than the target shutter speed of a camera in order to support doubling the apparent refresh rate to overcome dimming lines as described herein.

In some examples, the duration of each of the intervals 1002A-1002N may be less than half of the target shutter speed to ensure the described technique avoids dimming lines in LED display photography as described herein. To support the scan line operations 1004A-1004N for each of the intervals 1002A-1002N, a clock signal (GCLK) 1006 is used. In some example embodiments, GCLK is a pulse-width modulated (PWM) clock signal and the rate of GCLK is selected to achieve a desired duration of the intervals 1002A-1002N (e.g., a duration less than the target shutter rate).

FIG. 11 is a diagram of an LED display driver circuit 1100 (an example of each LED submodule 114A-114H in FIG. 1, the LED display driver circuit 200 in FIG. 2, or the LED display driver circuit related to the LED display driver circuit layout 700 in FIG. 7) in accordance with an example embodiment. As shown, the LED display driver circuit 1100 includes various pin or contacts for VCC, IREF, GND, SCLK, SIN, SOUT, GND, Line0-Line15, R0-R15, G0-G15, B0-B15, VB, VG, and VR. More specifically, the LED display driver circuit 1100 includes a VCC pin 1170, an IREF pin 1172, a GND pin 1174, Line0-Line15 pins 1184A-1184P, R0-R15 pins 1186A-1186P, G0-G15 pins 1188A-1188P, B0-B15 pins 1190A-1190P, a VB pin 1192, a VG pin 1194, and a VR pin 1196.

As shown, the VCC pin 1170 is coupled to an internal low-dropout regulator (LDO) 1128 and a bandgap voltage reference circuit 1126. The IREF pin 1172 is coupled to a 3-bits brightness control circuit 1122 powered by the bandgap voltage reference circuit 1126. The 3-bits brightness control circuit 1122 is coupled to a R/G/B 8-bits color control circuit 1124 configured to control channel drivers 1120 based on color control codes or related information. In the example of FIG. 11, the channel drivers 1120 are coupled to a channel control circuit 1112, where the operations of the channels drivers 1120 are a function of signals from the channel control circuit 1112 and signals from the R/G/B 8-bits color control circuit 1124. As shown, the channel drivers 1120 are coupled to channel circuitry 1160 including a set of current sources 1161 with current sources 1162A-1162P powered by VR for R0-R15, current sources 1164A-1164P powered by VG for G0-G15, and current sources 1166A-1166P power by VB for B0-B15, where the outputs of the channel drivers 1120 determine the amount of current provided by each of the respective current sources current sources 1162A-1162P, current sources 1164A-1164P, and current sources 1166A-1166P. In other example embodiments, when driving common anode LEDs instead of common cathode LEDs, the channel circuit 1160 includes current sinks instead of current sources.

In the example of FIG. 11, the LED display driver circuit 1100 also includes: a frequency multiplier circuit 1106 coupled to the SCLK pin 1176; and a decoder circuit 1108 and SRAM 1110 coupled to the SIN pin 1178. As shown, the frequency multiplier 1106, the decoder 1108, and the SRAM 1110 are also coupled to a digital core 1102 configured to provide control signals for components of the LED display driver circuit 1100 based on SCLK and data received via the SIN pin 1178. Example data received via the SIN pin 1178 includes color codes and a scan line sequence code, where the decoder 1108 operates to decode or parse the scan line sequence code from other data received via the SIN pin 1178. In some example embodiments, the scan line sequence code or related information (e.g., the information in table 500 of FIG. 5A, the information in table 510 of FIG. 5B, and/or the information in table 610 of FIG. 6B) is stored by storage elements 1104 of the digital core 1102. As needed, control signals from the digital core 1102 are provided to the channel control circuit 1112, a frame control circuit 1114, and/or a line control circuit 1116. Responsive to the output of the line control circuit 1116, line drivers 1118 coupled to the line control circuit 1116 control scan line switches (e.g., transistors M0-M15 in FIG. 11). More specifically, each respective control terminal of M0-M15 is coupled to the line drivers 1118, each respective first current terminal of M0-M15 is coupled to one of the Line0-Line15 pins 1184A-1184N, and each respective second current terminal of M0-M15 is coupled to GND. In operation, M0-M15 selectively conduct current responsive to a programmable sequence of control signals from the line drivers 1118 as described herein, where Line0-Line15 pins 1184A-1184P are coupled to LED anodes, while R0-R15 pins 1186A-1186P, G0-G15 pins 1188A-1188P, and B0-B15 pins 1190A-1190P are coupled to LED cathodes. With common anode LEDs, current sinks are used instead of the current sources 1162A-1162P, 1164A-1164P, and 1166A-1166N. On the other hand, with common cathode LEDs, the current sources 1162A-1162P, 1164A-1164P, and 1166A-1166N are used. Also, in some example embodiments, the LED display driver circuit 1100 is stackable with programmable scan line outputs (see e.g., FIGS. 8 and 9B).

In the example of FIG. 11, various other components are included in the LED display driver circuit 1100 including protection circuitry 1150 such as an overcurrent protection circuit 1152 and a line clamp 1154. The LED display driver circuit 1100 also includes LED management circuitry 1140 such as an LED short detection circuit 1142, an LED open detection circuit 1144, a pre-discharge circuit 1146, and a low grayscale compensation circuit 1148. The LED display driver circuit 1100 also includes: a thermal shutdown circuit 1132 configured to shut down the LED display driver circuit 1100 responsive to an overtemperature condition; and an undervoltage-lockout circuit 1130 configured to shut down the LED display driver circuit 1100 responsive to a low voltage condition (e.g., VCC dropping below a threshold).

In some example embodiments, an LED display driver circuit (e.g., each of the LED submodules 114A-114H in FIG. 1, the LED display driver circuit 200 in FIG. 2, an LED display driver circuit related to the LED display driver circuit layout 700 in FIG. 7, or the LED display driver circuit 1100 in FIG. 11) includes: a set of scan lines (e.g., scan lines 211A-211N in FIG. 2, Line0-Line31 in FIGS. 5A, 5B, 6B, scan line outputs Line0-Line 15 in FIGS. 7, 8, and 11), each scan line having a respective switch (e.g., $S_0$-$S_{N-1}$ in FIG. 2, or M0-M15 in FIG. 11); a set of channels (e.g., the set of channels 201A-201N in FIG. 2, R0-R15, G0-G15, B0-B15 in FIGS. 7 and 11, or OUTR0-OUTR15, OUTG0-OUTG15, OUTB0-OUTB15 in FIG. 8) coupled to each scan line of the set of scan lines; and a scan line controller (e.g., line driver 1118 and the digital core 1102) coupled to each respective switch of the set of scan lines, the scan line controller configured to provide a programmable sequence of control signals (e.g., $SL_0$-$SL_{N-1}$ in FIG. 2) to respective switches of the set of scan lines.

In some example embodiments, the LED display driver circuit includes a communication node (e.g., the SIN pin in FIGS. 7 and 11); and a decoder (e.g., decoder 1108 in FIG. 11) coupled to the communication node and configured to decode a scan line sequence code from data received via the communication node, wherein the scan line controller is configured to use the scan line sequence code to provide the programmable sequence of control signals (e.g., a programmable sequence of $SL_0$-$SL_{N-1}$). In some example embodiments, the LED display driver circuit includes a storage element (e.g., the storage elements 1104 in FIG. 11) coupled to the decoder and configured to store the scan line sequence code, wherein the scan line controller is configured to use the scan line sequence code stored in the storage element to provide the programmable sequence of control signals.

In some example embodiments, the sequence of control signals includes multiple partial sequences of control signals performed in order, each of the multiple partial sequences of control signals configured to skip over some of the switches of the set of scan lines. In some example embodiments, the multiple partial sequences includes a first partial sequence of control signals (e.g., $SL_0$, $SL_2$, etc.) and a second partial sequence of control signals (e.g., $SL_3$, $SL_3$, etc.), the first partial sequence of control signals configured to skip over every other switch of the set of scan lines in order, and the second partial sequence of control signals configured to skip over switches related to the first partial sequence of control signals.

In some example embodiments, the LED display driver circuit includes a storage element (e.g., the storage element 1104 in FIG. 11) that stores active scan line information (see e.g., the information in table 510 in FIG. 5B), wherein the scan line controller is configured to use the active scan line information and the scan line sequence code to provide the programmable sequence of control signals to only some switches of the set of scan lines. In some example embodiments, the LED display driver circuit includes a storage element (e.g., the storage element 1104 in FIG. 11) that stores inactive scan line information (see e.g., the information in table 510 in FIG. 5B), wherein the scan line controller is configured to use the inactive scan line information and the scan line sequence code to provide the programmable sequence of control signals to only some switches of the set of scan lines. In some example embodiments, the LED display driver circuit includes a set of scan line outputs (e.g., the scan lines outputs Line0-Line15 in FIGS. 7, 8, and 11) coupled to the set of scan lines, the set of scan line outputs configured to support an additional set of channels (e.g., the set of channels 201A-201N in FIG. 2) external to the LED display driver circuit based on the scan line sequence code.

In some example embodiments, a system (e.g., the system 100 in FIG. 1) includes: an LED display controller (e.g., the base board controller 108 and/or each on-board controller 118); and an LED display driver circuit (e.g., each of the LED submodules 114A-114H in FIG. 1, the LED display driver circuit 200 in FIG. 2, the LED display driver circuit related to the LED display driver circuit layout 700 in FIG. 7, or the LED display driver circuit 1100 in FIG. 11) coupled to the LED display controller and configured to receive LED data from the LED display controller. The LED display driver circuit includes: a set of scan lines (e.g., scan lines 211A-211N in FIG. 2, Line0-Line31 in FIGS. 5A, 5B, 6B, scan line outputs Line0-Line 15 in FIGS. 7, 8, and 11), each scan line having a respective switch (e.g., $S_0$-$S_{N-1}$ in FIG. 2, or M0-M15 in FIG. 11); a set of channels (e.g., the set of channels 201A-201N in FIG. 2, R0-R15, G0-G15, B0-B15 in FIGS. 7, 8, and 11) coupled to each scan line of the set of scan lines; and a scan line controller (e.g., line driver 1118 and the digital core 1102) coupled to each respective switch of the set of scan lines, the scan line controller configured to provide a programmable sequence of control signals (e.g., $SL_0$-$SL_{N-1}$ in FIG. 2) to respective switches of the set of scan lines.

In some example embodiments, the system also includes: a PCB (e.g., a PCB for each of the LED modules 110A-110N), wherein the LED display controller and the LED display driver circuit are mounted to the PCB; and a graphics card (e.g., the DVI graphics card 104 in FIG. 1) coupled to the PCB and configured to provide graphics data to the PCB, wherein the LED display controller is configured to generate LED data based on the graphics data, and the scan line sequence code is provided to LED display driver circuit with the LED data. In some example embodiments, the system includes a plurality of LED display driver circuits (e.g., each of the LED submodules 114A-114H in FIG. 1, the LED display driver circuit 200 in FIG. 2, a plurality of the LED display driver circuit related to the LED display driver circuit layout 700 in FIG. 7, or a plurality of the LED display driver circuit 1100 in FIG. 11) coupled to the LED display controller, each LED display driver circuit supporting a refresh rate of at least 4 KHz using a pulse width modulation clock signal at or below 80 MHz.

Figure 12:
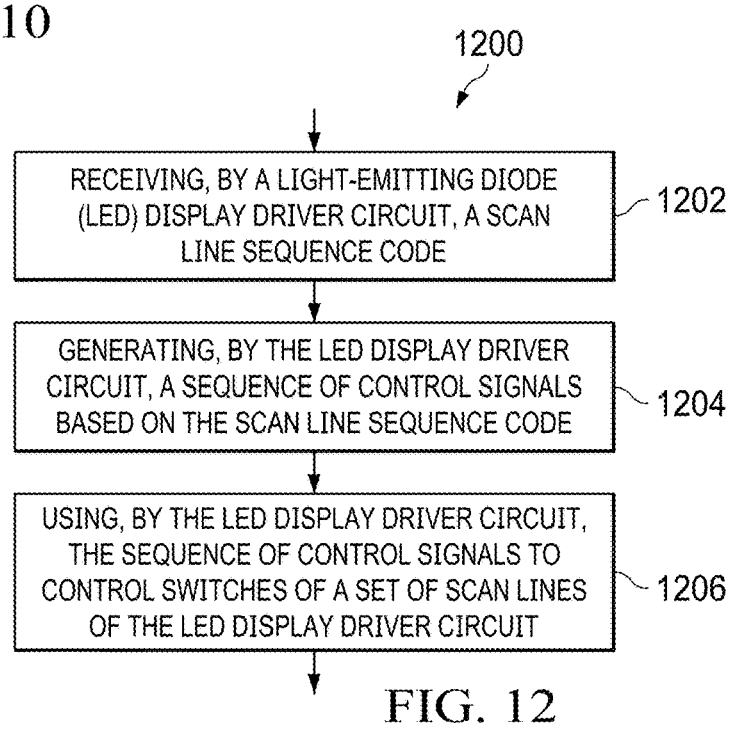
FIG. 12 is an LED display driver circuit method in accordance with an example embodiment.

FIG. 12 is an LED display driver circuit method 1200 in accordance with an example embodiment. The method 1200 is performed by an LED display driver circuit (e.g., each LED submodule 114A-114H in FIG. 1, the LED display driver circuit 200 in FIG. 2, the LED display driver circuit related to the LED display driver circuit layout 700 in FIG. 7, or the LED display driver circuit 1100 in FIG. 11). As shown, the method 1200 includes receiving by an LED display driver circuit, a programmable scan sequence code at block 1202. At block 1204, the LED display driver circuit generates a sequence of control signal based on the programmable scan sequence code. At block 1206, the LED display driver circuit uses the sequence of control signals to control switches of a set of scan lines of the LED display driver circuit.

In some example embodiments, generating a sequence of control signals at block 1204 involves generating multiple partial sequences of control signals performed in order, each of the multiple partial sequences of control signals configured to skip over some of the switches of the set of scan lines. In one example embodiment, the multiple partial sequences includes a first partial sequence of control signals and a second partial sequence of control signals, the first partial sequence of control signals configured to skip over every other switch of the set of scan lines in order, and the second partial sequence of control signals configured to skip over switches related to the first partial sequence of control signals.

In some example embodiments, the method 1200 also includes: storing, by the LED display driver circuit, the scan line sequence code and active scan line information; and generating, by the LED display driver circuit, the sequence of control signals based on the scan line sequence code and the active scan line information. In other example embodiments, the method 1200 includes storing, by the LED display driver circuit, the scan line sequence code and inactive scan line information; and generating, by the LED display driver circuit, the sequence of control signals based on the scan line sequence code and the inactive scan line information. In some example embodiments, the method 1200 also includes outputting, by the LED display driver circuit, scan line signals to support channels external to the LED display driver circuit based on the scan line sequence code.

In this description, the term "couple" may cover connections, communications, or signal paths that enable a functional relationship consistent with this description. For example, if device A generates a signal to control device B to perform an action: (a) in a first example, device A is coupled to device B by direct connection; or (b) in a second example, device A is coupled to device B through intervening component C if intervening component C does not alter the functional relationship between device A and device B, such that device B is controlled by device A via the control signal generated by device A.

Modifications are possible in the described embodiments, and other embodiments are possible, within the scope of the claims.

What is claimed is:

1. A light-emitting diode (LED) display driver circuit, comprising:

a set of scan lines, each scan line having a respective switch;

a set of channels coupled to each scan line of the set of scan lines; and a scan line controller coupled to each respective switch of the set of scan lines, the scan line controller configured to provide a programmable sequence of control signals to respective switches of the set of scan lines.

2. The LED display driver circuit of claim 1, further comprising:

a communication node; and a decoder coupled to the communication node and configured to decode a scan line sequence code from data received via the communication node, wherein the scan line controller is configured to use the scan line sequence code to provide the programmable sequence of control signals.

3. The LED display driver circuit of claim 2, further comprising a storage element coupled to the decoder and configured to store the scan line sequence code, wherein the scan line controller is configured to use the scan line sequence code stored in the storage element to provide the programmable sequence of control signals.

4. The LED display driver circuit of claim 1, wherein the sequence of control signals includes multiple partial sequences of control signals performed in order, each of the multiple partial sequences of control signals configured to skip over some of the switches of the set of scan lines.

5. The LED display driver circuit of claim 4, wherein the multiple partial sequences includes a first partial sequence of control signals and a second partial sequence of control signals, the first partial sequence of control signals configured to skip over every other switch of the set of scan lines in order, and the second partial sequence of control signals configured to skip over switches related to the first partial sequence of control signals.

6. The LED display driver circuit of claim 1, further comprising a storage element that stores active scan line information, wherein the scan line controller is configured to use the active scan line information and the scan line sequence code to provide the programmable sequence of control signals to only some switches of the set of scan lines.

7. The LED display driver circuit of claim 1, further comprising a storage element that stores inactive scan line information, wherein the scan line controller is configured to use the inactive scan line information and the scan line sequence code to provide the programmable sequence of control signals to only some switches of the set of scan lines.

8. The LED display driver circuit of claim 1, further comprising a set of scan line outputs coupled to the set of scan lines, the set of scan line outputs configured to support an additional set of channels external to the LED display driver circuit based on the scan line sequence code.

9. A system, comprising:

a light-emitting diode (LED) display controller; and an LED display driver circuit coupled to the LED display controller and configured to receive LED data from the LED display controller, the LED display driver circuit including:

a set of scan lines, each scan line having a respective switch;

a set of channels coupled to each scan line of the set of scan lines; and a scan line controller coupled to each respective switch of the set of scan lines, the scan line controller configured to provide a programmable sequence of control signals to respective switches of the set of scan lines.

10. The system of claim 9, the LED display driver circuit includes:

a communication node coupled to the LED display controller; and a decoder coupled to the second communication node and configured to decode a scan line sequence code from the LED data received from the LED display controller via the second communication node, wherein the scan line controller is configured to provide the programmable sequence of control signals to respective switches of the set of scan lines based on the scan line sequence code.

11. The system of claim 9, wherein the sequence of control signals includes multiple partial sequences of control signals performed in order, each of the multiple partial sequences of control signals configured to skip over some of the switches of the set of scan lines.

12. The system of claim 11, wherein the multiple partial sequences includes a first partial sequence of control signals and a second partial sequence of control signals, the first partial sequence of control signals configured to skip over every other switch of the set of scan lines in order, and the second partial sequence of control signals configured to skip over switches related to the first partial sequence of control signals.

13. The system of claim 10, wherein the LED display driver circuit includes a storage element that stores active or inactive scan line information, wherein the controller is configured to use the active or inactive scan line information and the scan line sequence code to provide the programmable sequence of control signals to only some switches of the set of scan lines.

14. The system of claim 9, wherein the LED display driver circuit includes a set of scan line outputs coupled to the set of scan lines, the set of scan line outputs configured to support an additional set of channels external to the LED display driver circuit based on the scan line sequence code.

15. The system of claim 9, further comprising:

a printed circuit board (PCB), wherein the LED display controller and the LED display driver circuit are mounted to the PCB; and a graphics card coupled to the PCB and configured to provide graphics data to the PCB, wherein the LED display controller is configured to generate LED data based on the graphics data, and the scan line sequence code is provided to LED display driver circuit with the LED data.

16. The system of claim 9, further comprising a plurality of LED display driver circuits coupled to the LED display controller, each LED display driver circuit supporting a refresh rate of at least 4 KHz using a pulse width modulation clock signal at or below 80 MHz.

17. A method, comprising:

receiving, by a light-emitting diode (LED) display driver circuit, a scan line sequence code;

generating, by the LED display driver circuit, a sequence of control signals based on the scan line sequence code; and using, by the LED display driver circuit, the sequence of control signals to control switches of a set of scan lines of the LED display driver circuit.

18. The method of claim 17, wherein the sequence of control signals includes multiple partial sequences of control signals performed in order, each of the multiple partial sequences of control signals configured to skip over some of the switches of the set of scan lines.

19. The method of claim 17, wherein the multiple partial sequences includes a first partial sequence of control signals and a second partial sequence of control signals, the first partial sequence of control signals configured to skip over every other switch of the set of scan lines in order, and the second partial sequence of control signals configured to skip over switches related to the first partial sequence of control signals.

20. The method of claim 17, further comprising:

storing, by the LED display driver circuit, the scan line sequence code and active scan line information; and generating, by the LED display driver circuit, the sequence of control signals based on the scan line sequence code and the active scan line information.

21. The method of claim 17, further comprising:

storing, by the LED display driver circuit, the scan line sequence code and inactive scan line information; and generating, by the LED display driver circuit, the sequence of control signals based on the scan line sequence code and the inactive scan line information.

22. The method of claim 17, outputting, by the LED display driver circuit, scan line signals to support channels external to the LED display driver circuit based on the scan line sequence code.

* * * * *